US008261407B2

(12) United States Patent
Bozzelli et al.

(10) Patent No.: US 8,261,407 B2
(45) Date of Patent: Sep. 11, 2012

(54) VACUUM CLEANER ACCESSORY TOOL

(75) Inventors: Robert F. Bozzelli, Munroe Falls, OH (US); Chris Charlton, Medina, OH (US); Andy Chick, Cleveland, OH (US); Matt Doerfler, Wooster, OH (US); Markus Allemann, Chargin Falls, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 412 days.

(21) Appl. No.: 12/552,138

(22) Filed: Sep. 1, 2009

(65) Prior Publication Data

US 2011/0047744 A1 Mar. 3, 2011

(51) Int. Cl.
*A47L 9/00* (2006.01)

(52) U.S. Cl. ..... 15/365; 15/367; 15/375; 15/387; 15/398; 15/416; 15/421

(58) Field of Classification Search ..... 15/365, 15/367, 375, 387, 398, 416, 421; *A47L 9/00, A47L 9/06*

See application file for complete search history.

(56) References Cited

U.S. PATENT DOCUMENTS

| | | | | |
|---|---|---|---|---|
| 943,424 | A | 12/1909 | Lacock | |
| 963,049 | A | 7/1910 | Kenney | |
| 1,042,711 | A | 10/1912 | Moorhead | |
| 2,130,635 | A | 9/1938 | Dow et al. | |
| 2,659,925 | A | 11/1953 | Wood | |
| 2,707,792 | A | 5/1955 | Waller | |
| 3,320,629 | A | 5/1967 | Zaidan | |
| 3,708,824 | A | 1/1973 | Holubinka | |
| 3,750,222 | A | 8/1973 | Johnson | |
| 4,109,342 | A | 8/1978 | Vermillion | |
| 4,332,051 | A | 6/1982 | LaMonte | |
| 4,864,681 | A * | 9/1989 | Hult et al. | 15/367 |
| 5,029,361 | A | 7/1991 | Murata et al. | |
| 5,060,342 | A | 10/1991 | Brazier | |
| 5,067,199 | A | 11/1991 | Alazet | |
| 5,103,527 | A | 4/1992 | Holland | |
| 5,373,598 | A | 12/1994 | Weber et al. | |

(Continued)

FOREIGN PATENT DOCUMENTS

DE 10139213 2/2003

(Continued)

OTHER PUBLICATIONS

Search Report from the European Patent Office for Application No. 10251535.0 dated May 25, 2012 (7 pages).

*Primary Examiner* — David Redding
(74) *Attorney, Agent, or Firm* — Michael Best & Friedrich LLP

(57) ABSTRACT

A vacuum cleaner accessory tool configured for use with a vacuum cleaner. The vacuum cleaner is operable to draw air through a suction hose to clean a surface. The accessory tool includes a housing that defines a chamber, and the housing includes an exterior surface and an interior surface. An outlet conduit is in fluid communication with the chamber, and the outlet conduit is configured to couple the accessory tool to the suction hose. A suction inlet aperture extends through the housing to provide fluid communication into the chamber. The accessory tool further includes a brush assembly extending from the exterior surface of the housing, and the brush assembly includes an auxiliary aperture to provide fluid communication into the chamber.

19 Claims, 8 Drawing Sheets

U.S. PATENT DOCUMENTS

| | | | |
|---|---|---|---|
| 5,535,475 | A | 7/1996 | Sauter |
| 5,950,275 | A | 9/1999 | Worwag |
| 6,032,327 | A | 3/2000 | Oka et al. |
| 6,134,746 | A | 10/2000 | Miller et al. |
| 6,256,832 | B1 | 7/2001 | Dyson |
| 6,324,714 | B1 | 12/2001 | Walz et al. |
| 6,477,735 | B2 | 11/2002 | Worwag |
| 6,484,357 | B1 | 11/2002 | Dong |
| 6,581,240 | B2 | 6/2003 | Kaffenberger |
| 6,615,445 | B2 | 9/2003 | Worwag |
| 7,146,682 | B2 | 12/2006 | Damman et al. |
| 7,168,129 | B2 | 1/2007 | Smith |
| 7,278,181 | B2 | 10/2007 | Harris et al. |
| 7,299,521 | B2 | 11/2007 | Theiss, Jr. et al. |
| 2005/0044659 | A1 | 3/2005 | Rickman |
| 2006/0042043 | A1 | 3/2006 | Kim |
| 2006/0248680 | A1* | 11/2006 | Heidenga et al. ..... 15/387 |
| 2008/0196198 | A1 | 8/2008 | Labarbera et al. |
| 2009/0070955 | A1 | 3/2009 | Hollis |
| 2009/0119871 | A1 | 5/2009 | Dilger et al. |

FOREIGN PATENT DOCUMENTS

| | | | |
|---|---|---|---|
| GB | 2090728 | | 7/1982 |
| JP | 6343586 | A | 12/1994 |
| JP | 10127542 | A | 5/1998 |

* cited by examiner

VACUUM CLEANER ACCESSORY TOOL

BACKGROUND

The present invention relates to vacuum cleaner accessory tools.

Vacuum cleaners are often supplied with multiple accessory tools. For example, in one type of vacuum, an upright vacuum, the vacuum includes a foot or main nozzle that is in fluid communication with a dirt cup and the dirt cup is in fluid communication with a fan that is operable to generate a suction air flow through the foot and the dirt cup. The main nozzle often includes a brush roll or agitator and the user moves the main nozzle along a surface to be cleaned, typically carpet or other types of flooring. The main nozzle and the dirt cup can be fluidly coupled by a suction hose that is in fluid communication with the fan. An end of the suction hose is often removably coupled to the main nozzle. The user can uncouple this end of the hose from the main nozzle and attach an accessory tool for cleaning furniture, stairs, or other areas where it is not convenient to use the main nozzle.

SUMMARY

In one embodiment, the invention provides a vacuum cleaner accessory tool configured for use with a vacuum cleaner. The vacuum cleaner is operable to draw air through a suction hose to clean a surface. The accessory tool includes a housing that defines a chamber, and the housing includes an exterior surface and an interior surface. An outlet conduit is in fluid communication with the chamber, and the outlet conduit is configured to couple the accessory tool to the suction hose. A suction inlet aperture extends through the housing to, provide fluid communication into the chamber. The accessory tool further includes a brush assembly extending from the exterior surface of the housing, and the brush assembly includes an auxiliary aperture to provide fluid communication into the chamber.

In another embodiment the invention provides a vacuum cleaner accessory tool configured for use with a vacuum cleaner operable to draw air through a suction hose to clean a surface. The accessory tool includes a housing that defines a chamber, and the housing includes an exterior surface and an interior surface. An outlet conduit is in fluid communication with the chamber, and the outlet conduit is configured to couple the accessory tool to the suction hose. The accessory tool further includes a suction inlet aperture that extends through the housing to provide fluid communication into the chamber, and a brush assembly having a base member and a brush member that extends from the base member. The base member is removably coupled to the exterior surface of the housing such that the brush member extends from the exterior surface of the housing.

Other aspects of the invention will become apparent by consideration of the detailed description and accompanying drawings.

Before any embodiments of the invention are explained in detail, it, is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
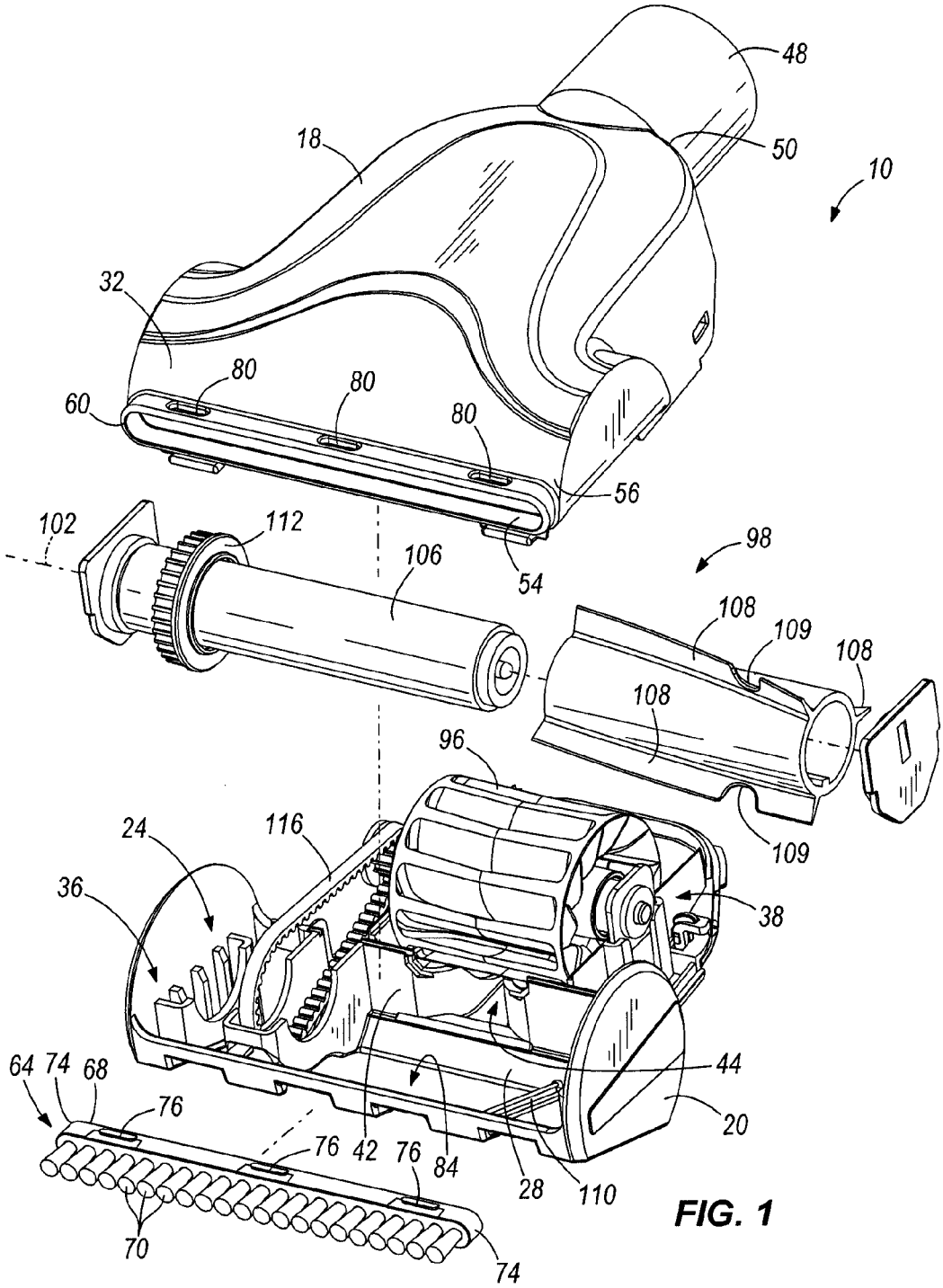
FIG. 1 is a partially exploded view of a vacuum cleaner accessory tool according to one embodiment of the invention.
Figure 2:
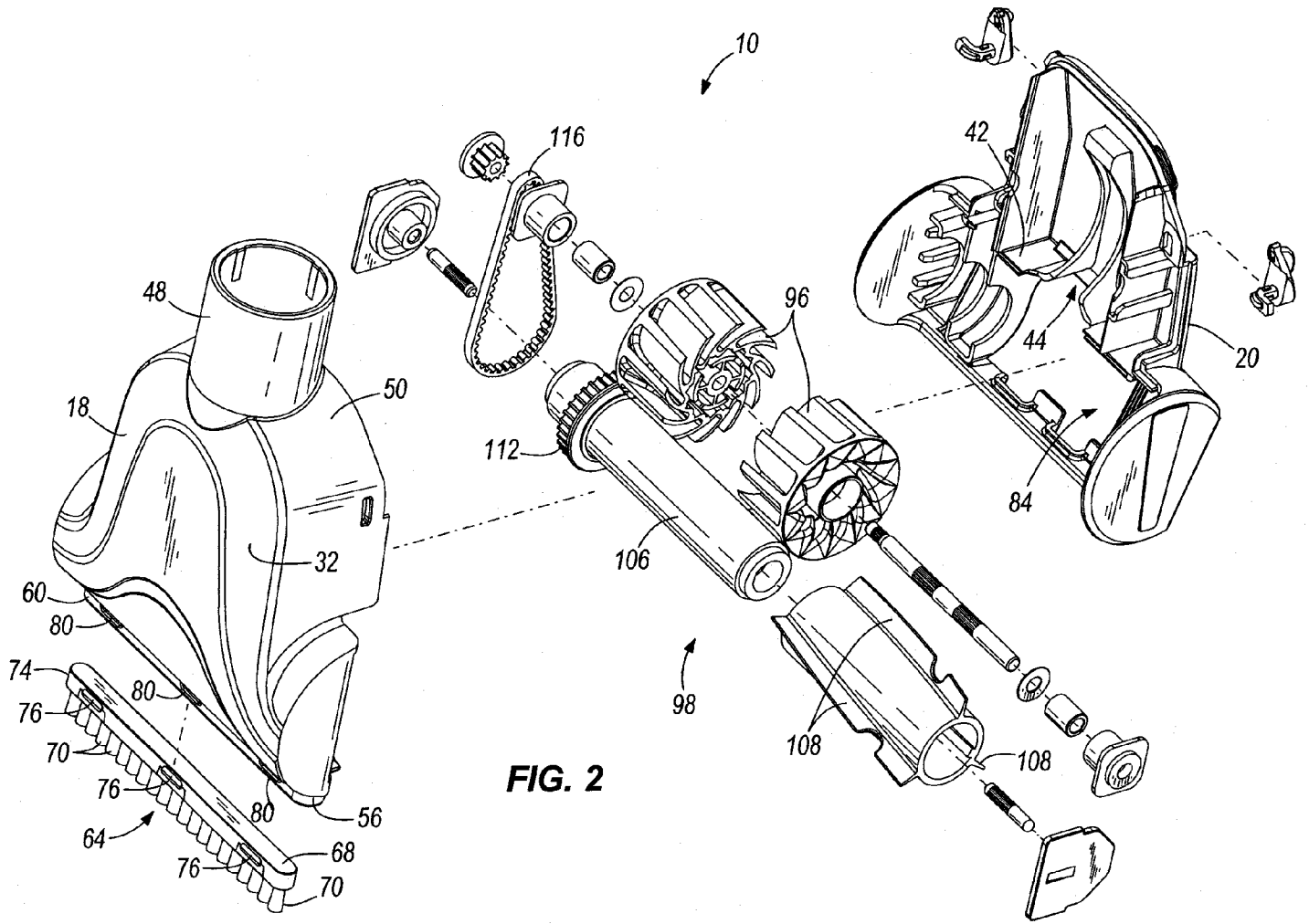
FIG. 2 is an alternative exploded view of the accessory tool of FIG. 1.

FIG. 1 illustrates a vacuum cleaner accessory tool 10 that can be coupled to a suction hose of a vacuum cleaner for use with the vacuum cleaner to clean or remove debris from a surface, such as upholstery, furniture, carpeting, other flooring and the like. The accessory tool 10 includes a housing 14. In the illustrated embodiment, the housing 14 is a two-part housing that includes an upper portion 18 and a lower portion 20. In one embodiment, the upper portion 18 and the lower portion 20 are molded from plastic. In other embodiments, other suitable materials and forming methods can be used to make the housing portions 18 and 20.

Figure 6:
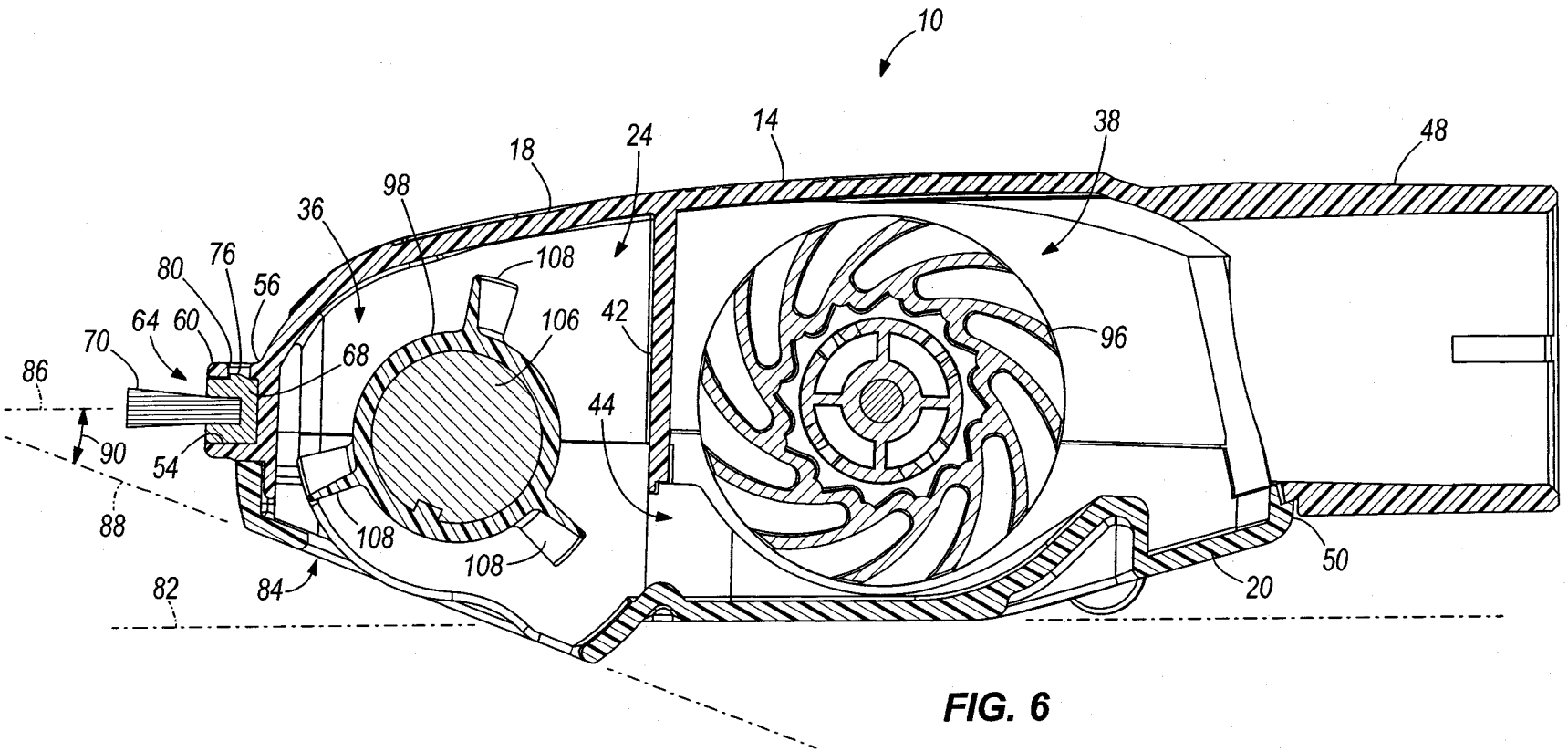
FIG. 6 is a cross-sectional view of the accessory tool of FIG. 1 taken along lines 6-6 of FIG. 4.
Figure 8:
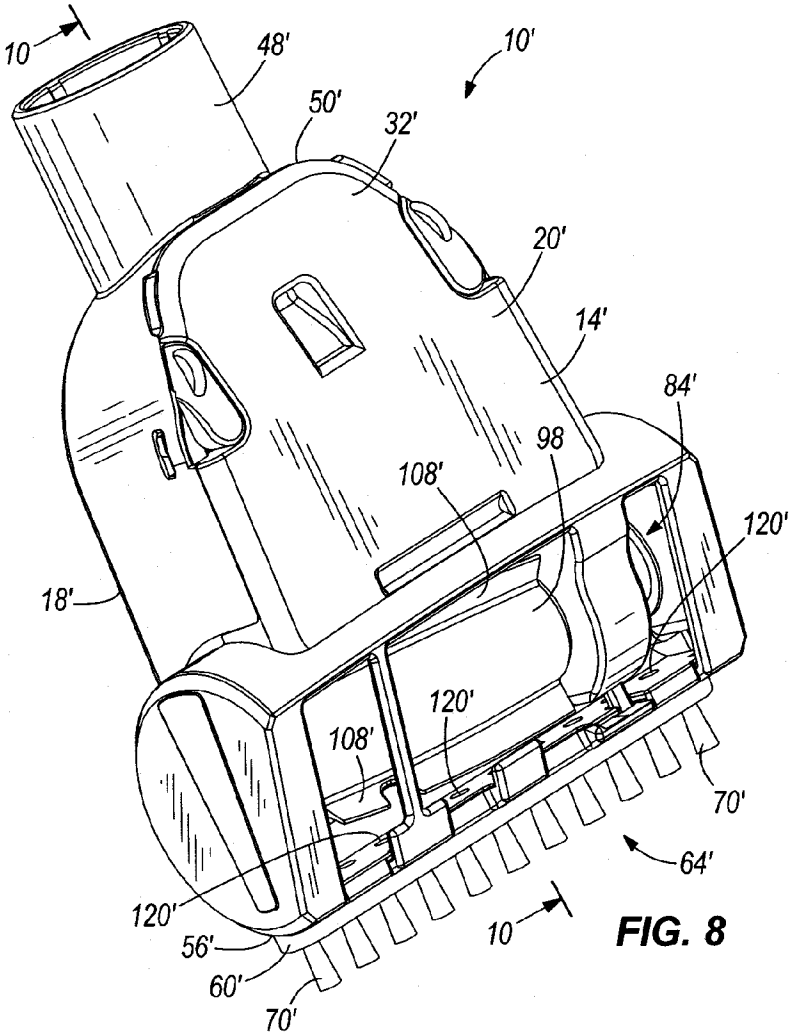
FIG. 8 is an alternative perspective view of the accessory tool of FIG. 7.

As best seen in FIG. 6, the upper portion 18 and the lower portion 20 are coupled to define a vacuum chamber 24 that is generally bounded by an interior surface 28 of the housing 14, which is opposite an exterior surface 32 of the housing 14. The illustrated vacuum chamber 24 includes a forward portion 36 and a rearward portion 38 that are partially separated by a wall 42. An opening 44 in the wall 42 provides fluid communication between the forward portion 36 and the rearward portion 38 of the chamber 24.

Referring to FIGS. 1 and 6, an outlet conduit 48 extends from a trailing end 50 or rear end of the housing 14. In the illustrated embodiment, the outlet conduit 48 is integrally formed as a single component with the upper portion 18 of the housing 14 so that the outlet conduit 48 is fixed with respect to the upper portion 18 of the housing 14. In other embodiments, the outlet conduit 48 can be formed from a combination of the upper portion 18 and the lower portion 20 of the housing 14. Also, although in the illustrated embodiment, the outlet conduit 48 is fixed with respect to the housing 14, in other embodiments, the conduit 48 can be formed to pivot with respect to the housing 14. As best seen in FIG. 6, the outlet conduit 48 is in fluid communication with the rearward, portion 38 of the chamber 24, and as would be understood by one of skill in the art, the outlet conduit 48 can be used to removably couple the accessory tool 10 to a vacuum cleaner hose.

With continued reference to FIGS. 1 and 6, an elongated aperture 54 is formed on a leading end 56 or forward end of the housing 14. The elongated aperture 54 is formed by a wall 60 that extends from the exterior surface 32 of the upper portion 18 of the housing 14. In the illustrated is integrally embodiment, the wall 60 is integrally formed as a single component with the upper portion 18 of the housing 14. As best seen in FIG. 6, in the illustrated embodiment, the aperture 54 formed by the wall 60 does not extend through the upper portion 18 of the housing 14.

A brush assembly 64 is coupled to the upper portion 18 of the housing 14 using the elongated aperture 54. The brush assembly 64 includes a base member 68 and brush members 70 that extend from the base 68, generally normal to the base 68 in the illustrated embodiment. In the illustrated embodiment, the base member 68 is elongated and includes rounded ends 74 and projections 76 that extend from the top of the base 68. The base member 68 is sized so that the base member 68 is received in the elongated aperture 54 of the housing 14 and the base member 68 remains coupled within the aperture 54 by an interference fit between the base member 68 and the wall 60. The projections 76 each extend into an aperture 80 or recess formed in the wall 80 to facilitate the connection between the base 68 and the housing 14. In the illustrated embodiment, the brush assembly 64 is removably coupled to the housing 14 and therefore, the brush assembly 64 can be replaced with different types of brush assemblies or the brush assembly 64 can be replaced when it becomes excessively worn.

Figure 5:
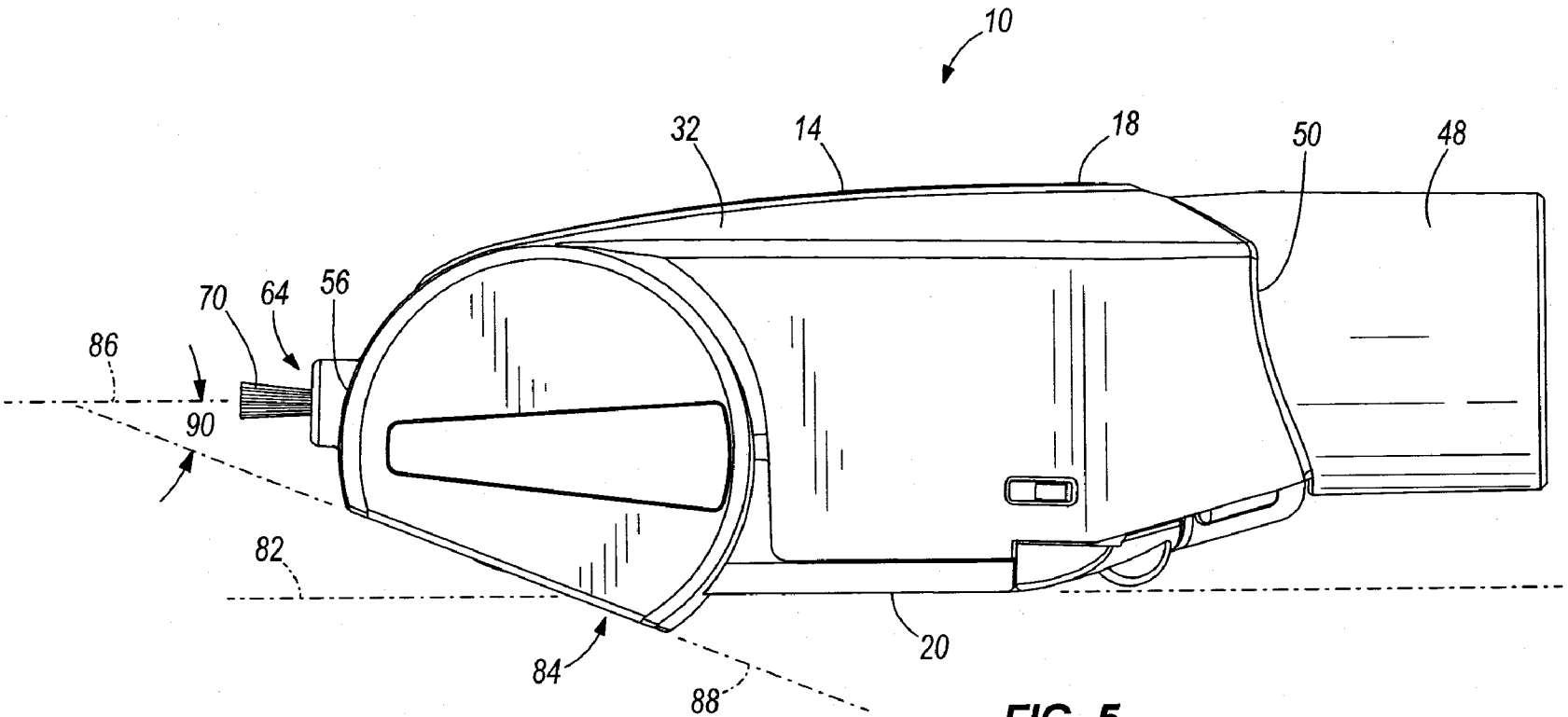
FIG. 5 is a side view of the accessory tool of FIG. 1 assembled.

As best seen in FIG. 1, the brush members 70 are arranged in a straight row along the base member 68. In the illustrated embodiment, each of the brush members 70 includes a plurality of nylon bristles (FIG. 6). In other embodiments, other types of brush members can be used, such as rubber knobs, and in yet other embodiments, a single brush member, such as a flexible resilient wiper blade can be used. As best seen in FIG. 6, when the base 68 is coupled to the housing 14, the brush members 70 extend from the leading end 56 of the housing 14 to form a forward most point of the tool 10. Also, if the lower portion 20 of the housing 14 is set on a generally flat surface 82 to be cleaned (e.g., a floor) as illustrated in FIGS. 5 and 6, the brush members 70 extend (e.g., longitudinal axes 86 of the brush members 70) generally parallel with respect to the surface 82. During use of the accessory tool 10, the user may position the tool 10 so that the suction inlet aperture 84 either lies flat on the surface 82 or alternatively stated, a plane 88 through the suction inlet aperture 84 is generally co-planar with the surface 82.

Referring to FIGS. 1 and 6, the lower portion 20 of the housing 14 includes a suction inlet aperture 84 that provides fluid communication into the forward portion 36 of the chamber 24 from outside of the housing 14. The illustrated suction inlet aperture 84 lies in the plane 88 that is at an angle 90 with respect to the longitudinal axes 86 of the brush members 70. In the illustrated embodiment, the angle 90 is about 20 degrees. In other embodiments, the angle 90 can range from about 10 degrees to about 30 degrees. In other embodiments, the angle 90 can be any suitable angle, and in yet other embodiments, the longitudinal axes 86 of the brush members 70 can be parallel to the plane 88 of the suction inlet aperture 84.

Figure 4:
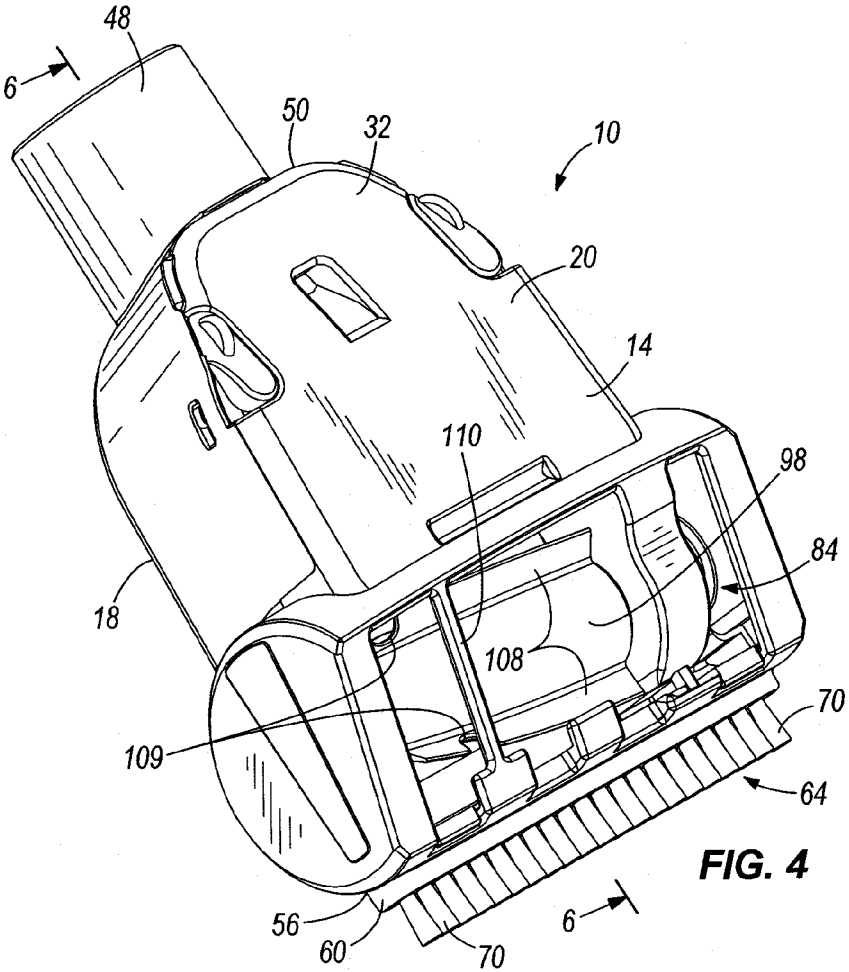
FIG. 4 is an alternative perspective view of the assembled accessory tool of FIG. 1.
Figure 3:
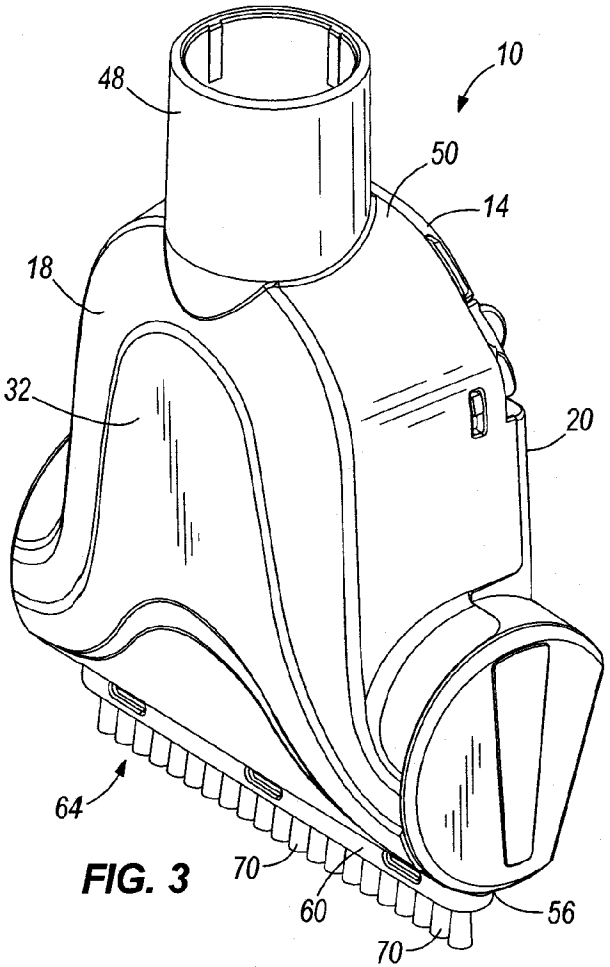
FIG. 3 is a perspective view of the assembled accessory tool of FIG. 1.

A drive member 96 and an agitator 98 are coupled to the housing 14 within the vacuum chamber 24. The agitator 98 is positioned in the forward portion 36 of the chamber 24 above and adjacent the suction inlet aperture 84. The agitator 98 is coupled to the housing 14 for rotation with respect to the housing 14 about an axis 102. The illustrated agitator 98 includes a base roller 106 and a plurality of resilient flexible blades 108 that are coupled to the base roller 106 for co-rotation. In one embodiment, the blades 108 are over-molded onto the base roller 106 and the blades 108 have longitudinally axes that are curved with respect to the agitator axis 102 so that the blades 108 form a helix about the base roller 106 as illustrated in FIGS. 1 and 6. As best seen in FIGS. 1 and 4, each of the blades 108 includes a cut-out 109. The cut-outs 109 allow the blades 108 to pass by a support member 110 of the lower portion 20 so that the blades 108 do not contact or rub against the support member 110.

As best seen in FIG. 1, a gear 112 is coupled to the base roller 106. The gear 112 receives a belt 116 that couples the agitator 98 and the drive member 96 so that the drive member 96 is operable to drive or rotate the agitator 98 about the axis 102. In the illustrated embodiment, the drive member 96 is an air turbine. In other embodiments, the drive member 96 can include an electric motor and the like.

In operation, a user couples the accessory tool 10 to a hose of a vacuum cleaner, typically by inserting the outlet conduit 48 into the hose of the vacuum. With the vacuum 'on' or generating a suction, air is drawn through the suction inlet aperture 84 and into the forward portion 36 of the chamber 24. The air flows through the opening 44 in the wall 42 and into the rearward portion 38 of the chamber 24. This flow of air turns the air turbine or drive member 96, and the air turbine 96 drives or rotates the agitator 98 about the axis 102. The air and debris drawn therewith exits the chamber 24 through the outlet conduit 48 and travels into the hose of the vacuum cleaner.

The user moves the suction inlet aperture 84 along the surface 82 to remove dirt, dust, and other debris from the surface 82. Meanwhile, the blades 108 agitate the surface to facilitate removal of the debris from the surface 82. The resilient flexible blades 108 of the agitator 98 are particularly well suited for removing hair, such as pet hair, from the cleaning surface 84. Also, during operation, the user may find that the agitator 98 alone cannot remove certain debris, such as hair, from the surface 82. For example, pet hair can be tangled in furniture or carpeting. If so, the user can use the brush assembly 64 to loosen the hair from the surface 82 by moving the brush members 70 along the surface 82. With the hair loosened, the user can then place the suction inlet aperture 84 and agitator 98 over the hair to draw the hair through the tool 10 and into the vacuum. Also, the user may find that they cannot remove debris that is close to corners, walls, edges, etc. If so, the user can use the brush members 70 to move the debris away from the corner, wall, edge, etc. before vacuuming through the inlet aperture 84. Although the accessory tool 10 illustrated and described herein is a turbo-type tool having the rotatable agitator 98', in other embodiments, the tool can be a static tool having a dusting brush and the like.

FIGS. 7-10 illustrate an alternative embodiment of the accessory tool of FIGS. 1-6. The embodiment of FIGS. 7-10 is similar to the embodiment of FIGS. 1-6, and therefore, only the differences between the embodiments will be discussed herein and like components have been given like reference numbers with the addition of a prime symbol.

Figure 7:
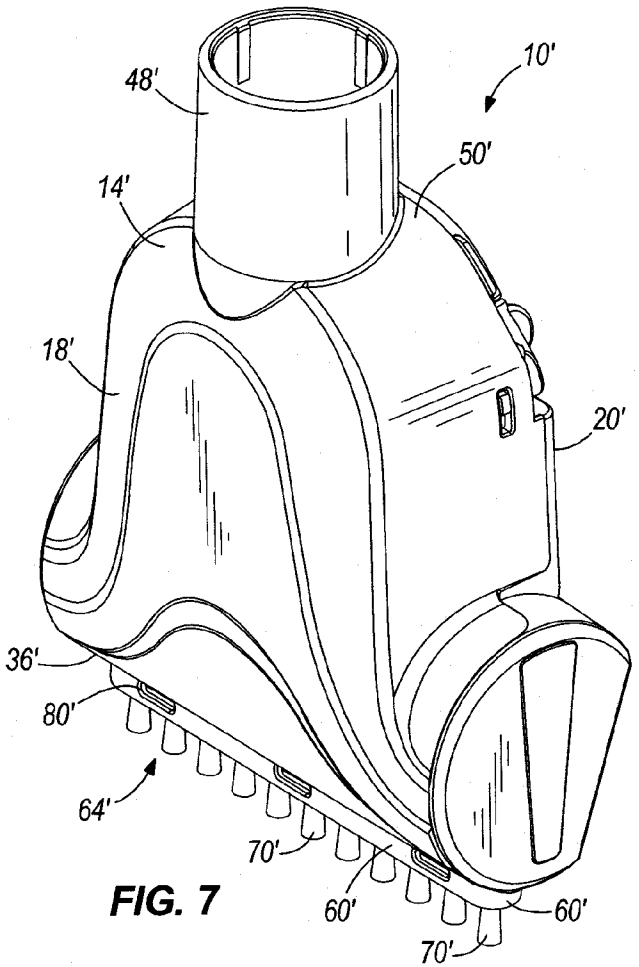
FIG. 7 is a perspective view of an accessory tool according to a second embodiment of the invention.
Figure 9:
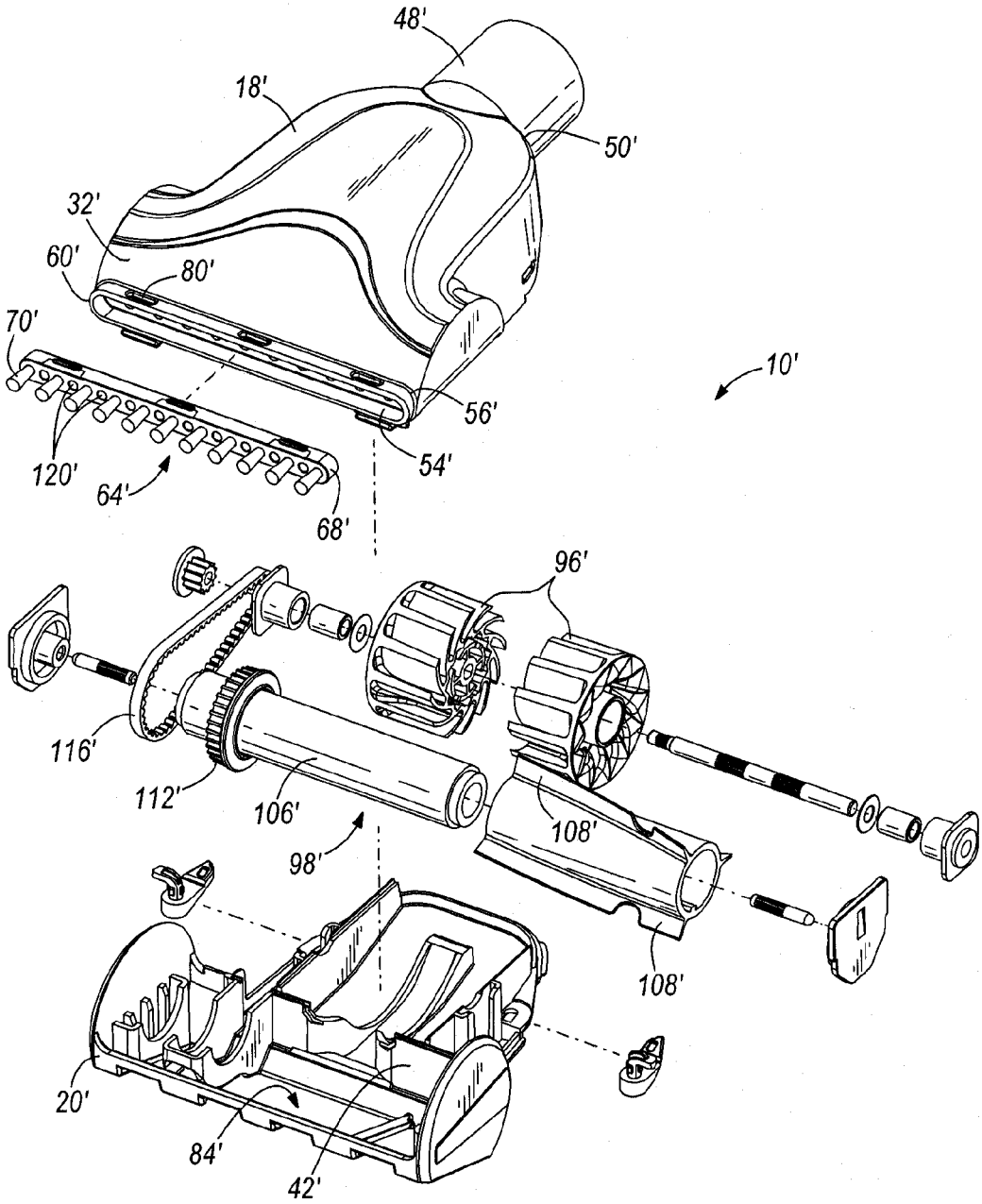
FIG. 9 is an exploded view of the accessory tool of FIG. 7.
Figure 10:
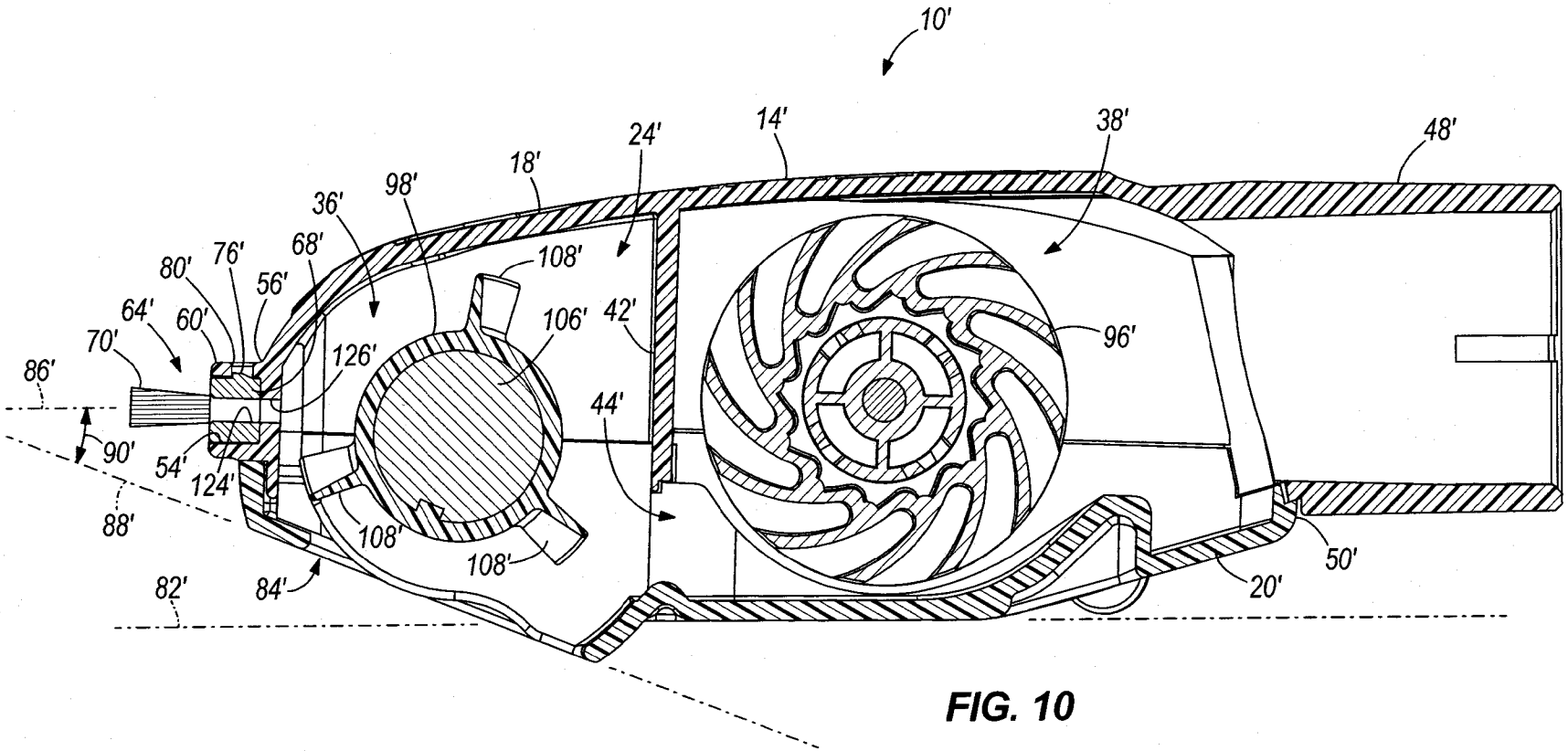
FIG. 10 is a cross-sectional view of the accessory tool of FIG. 7 taken along lines 10-10 of FIG. 8.

Referring to FIGS. 9 and 10, the accessory tool 10' includes auxiliary apertures 120' that extend through the brush assembly 64' and the housing 14' to provide fluid communication into the chamber 24'. The apertures 120' include a first portion 124' that extends through the base member 68' of the brush assembly 64' and a second portion 126' that extends through the upper portion 18 of the housing 14. As best seen in FIG. 9, the illustrated tool 10' includes a plurality of apertures 120' arranged in the row of the brush members 70', and in the illustrated embodiment, the apertures 120' take the place of the alternate brush members 70 in the embodiment of FIGS. 1-6. Accordingly, one aperture 120' (FIG. 7) is located directly between alternating brush members 70' (FIG. 7). In the illustrated embodiment, the first portion 124' of the aperture 120' is fully defined by the base member 68'. In other embodiments the apertures 120', including the first portion 124' can take other forms and shapes. For example, in one embodiment, the first portion 124' of the aperture 120' may be formed from a notch in the base member 68' so that the first portion 124' of the aperture 120' is partially formed by the base 68' and the wall 60'. In yet other embodiments, the apertures 120' may be formed adjacent the brush assembly 64' so that the apertures 120' do not extend through the brush assembly 64'.

During operation of the accessory tool 10', air is drawn through the apertures 120' as well as the main suction inlet aperture 84'. Then, when the user uses the brush assembly 64' as described above, the apertures 120' can also remove debris from the surface 82'. Also, if air flow is restricted through the suction inlet aperture 84', the apertures 120' provide bleed holes or alternative flow paths for air to drive the air turbine 96. Although the accessory tool 10 illustrated and described herein is a turbo-type tool having the rotatable agitator 98', in other embodiments, the tool can be a static tool having a dusting brush and the like.

Various features and advantages of the invention are set forth in the following claims.

What is claimed is:

1. A vacuum cleaner accessory tool configured for use with a vacuum cleaner, the vacuum cleaner operable to draw air through a suction hose to clean a surface, the accessory tool comprising:

a housing that defines a chamber, the housing including an exterior surface and an interior surface;

an outlet conduit in fluid communication with the chamber, the outlet conduit configured to couple the accessory tool to the suction hose;

a suction inlet aperture that extends through the housing to provide fluid communication into the chamber;

a brush assembly extending from the exterior surface of the housing, the brush assembly including an auxiliary aperture to provide fluid communication into the chamber; and an agitator rotationally coupled to the housing at least partially within the chamber and adjacent the suction inlet aperture.

2. The accessory tool of claim 1, wherein the brush assembly includes a base member coupled to the housing and a brush member that extends from the base member, wherein the auxiliary aperture extends through the base member adjacent the brush member.

3. The accessory tool of claim 2, wherein the brush assembly includes a plurality of brush members arranged in a row along the base member, wherein the brush assembly includes a plurality of auxiliary apertures arranged in the row.

4. The accessory tool of claim 2, wherein the housing includes an upper housing and a lower housing, wherein the lower housing includes the suction inlet aperture, and wherein the upper housing includes an elongated aperture that receives the base member to couple the brush assembly to the housing.

5. The accessory tool of claim 4, wherein the auxiliary aperture includes a first portion that extends through the base member of the brush assembly and a second portion that extends through the upper housing.

6. The accessory tool of claim 1, wherein the brush assembly includes a base member coupled to the housing and a brush member that extends from the base member, wherein the brush member includes nylon bristles.

7. The accessory tool of claim 1, wherein the brush assembly includes a base member coupled to the housing and a brush member that extends from the base member, wherein the brush member includes a rubber knob.

8. The accessory tool of claim 1, further comprising an air turbine positioned within the chamber, wherein the air turbine is operable to rotate the agitator.

9. The accessory tool of claim 1, wherein the housing defines a leading end and a trailing end opposite the leading end, wherein the outlet conduit extends from the trailing end, and wherein the brush assembly extends from the leading end.

10. A vacuum cleaner accessory tool configured for use with a vacuum cleaner operable to draw air through a suction hose to clean a surface, the accessory tool comprising:

a housing that defines a chamber, the housing including an exterior surface and an interior surface;

an outlet conduit in fluid communication with the chamber, the outlet conduit configured to couple the accessory tool to the suction hose;

a suction inlet aperture that extends through the housing to provide fluid communication into the chamber; and a brush assembly having a base member and a brush member that extends from the base member, the base member removably coupled to the exterior surface of the housing such that the brush member extends from the exterior surface of the housing;

wherein the housing includes an elongated aperture that receives the base member to removably coupled the brush assembly to the housing and wherein the housing defines a leading end and a trailing end opposite the leading end, wherein the outlet conduit extends from the trailing end, wherein the brush assembly extends from the leading end such that the brush member forms a forward most point of the accessory tool.

11. The accessory tool of claim 10, wherein the base member is coupled to the housing at least partially within the elongated aperture using an interference fit.

12. The accessory tool of claim 10, wherein the housing includes an upper housing and a lower housing coupled to the upper housing, wherein the lower housing includes the suction inlet aperture, and wherein the upper housing includes the elongated aperture.

13. The accessory tool of claim 10, further comprising, an agitator rotationally coupled to the housing at least partially within the chamber and adjacent the suction inlet aperture, the agitator including a plurality of flexible resilient blades; and a drive member operable to rotate the agitator.

14. The accessory tool of claim 10, further comprising, an agitator rotationally coupled to the housing at least partially within the chamber and adjacent the suction inlet aperture; and an air turbine positioned within the chamber, wherein the air turbine is operable to rotate the agitator.

15. The accessory tool of claim 10, wherein the brush assembly includes a plurality of brush members arranged in a row, and wherein the brush members are formed from nylon bristles.

16. The accessory tool of claim 10, wherein the brush assembly includes an auxiliary aperture that extends through the base member of the brush assembly and the housing to provide fluid communication into the chamber.

17. The accessory tool of claim 16, wherein the brush assembly includes a plurality of brush members arranged in a row along the base member, wherein the brush assembly includes a plurality of auxiliary apertures arranged in the row.

18. A vacuum cleaner accessory tool configured for use with a vacuum cleaner, the vacuum cleaner operable to draw air through a suction hose to clean a surface, the accessory tool comprising:

a housing that defines a chamber, the housing including an exterior surface and an interior surface;

an outlet conduit in fluid communication with the chamber, the outlet conduit configured to couple the accessory tool to the suction hose;

a suction inlet aperture that extends through the housing to provide fluid communication into the chamber; and a brush assembly extending from the exterior surface of the housing, the brush assembly including an auxiliary aperture to provide fluid communication into the chamber, wherein the brush assembly includes a base member coupled to the housing and a brush member that extends from the base member, wherein the auxiliary aperture extends through the base member adjacent the brush member, and wherein the housing includes an upper housing and a lower housing, wherein the lower housing includes the suction inlet aperture, and wherein the upper housing includes an elongated aperture that receives the base member to couple the brush assembly to the housing.

19. The accessory tool of claim 18, wherein the auxiliary aperture includes a first portion that extends through the base member of the brush assembly and a second portion that extends through the upper housing.

* * * * *